US005217759A

United States Patent [19]

Lamberigts et al.

[11] Patent Number: 5,217,759

[45] Date of Patent: Jun. 8, 1993

[54] PROCESS FOR THE CONTINUOUS DIP COATING OF A STEEL STRIP

[75] Inventors: Marcel Lamberigts; Vincent Leroy, both of Liege, Belgium

[73] Assignee: Centre de Recherches Metallurgiques-Centrum Voor Research in de Metallurgie, Brussels, Belgium

[21] Appl. No.: 684,285

[22] Filed: Apr. 12, 1991

[30] Foreign Application Priority Data

Apr. 13, 1990 [BE] Belgium ..... 09000420
Apr. 2, 1991 [BE] Belgium ..... 09100298

[51] Int. Cl.[5] ..... B05D 1/18

[52] U.S. Cl. ..... 427/433; 427/434.2; 427/436

[58] Field of Search ..... 427/433, 436, 434.2

[56] References Cited

U.S. PATENT DOCUMENTS 3,937,858 2/1976 Thiele ..... 427/431
3,952,120 4/1976 Horton et al. ..... 427/433
4,418,984 12/1983 Wysocki et al. ..... 427/163
4,456,663 6/1984 Leonard ..... 428/653
4,595,600 6/1986 Keeven et al. ..... 427/320

*Primary Examiner*—Shrive Beck
*Assistant Examiner*—Katherine A. Bareford
*Attorney, Agent, or Firm*—Jacobson, Price, Holman & Stern

[57] ABSTRACT

A process for continuous dip coating of a steel strip by passing it through a zinc bath containing aluminum and silicon wherein the aluminum content is approximately 55% by weight, the silicon content is 1% to 2% by weight, and the bath further includes strontium in a quantity in the range of 0.0001% to 0.2% by weight and at least one other element selected from among vanadium in a quantity in the range of 0.02% to 0.2% by weight and chromium in the range of 0.005% to 0.2% by weight. The addition of strontium and chromium and/or vanadium stabilizes the structure of the coating and reduces the formation of acicular precipitates of silicon. The coating has an improved adherence and ductility which permits it to be formed without cracking, while retaining an excellent resistance to corrosion. The resulting crystallization pattern of the coating is also finer and more regular and is independent of the substrate.

4 Claims, 7 Drawing Sheets

| Sr ($10^{-3}$%) | V ($10^{-3}$%) | e (mm) | $\bar{e}$ (mm) | AZ (μm) | n | $\bar{n}$ | L (μm) | $\bar{L}$ (μm) | S (%) | $\bar{S}$ (%) | $\frac{\bar{n} \times \bar{L}}{10 \times \pi \times e}$ (%) |
|---|---|---|---|---|---|---|---|---|---|---|---|
| 15 | 15 | 0,8<br>1,2<br>2,0 | 1,3 | 25 | 14<br>27<br>46 | 29 | 10<br>30<br>25 | 22 | 5<br>20<br>18 | 14 | 16 |
| 23 | 28 | 0,6<br>1,0<br>1,2 | 0,9 | 22 | 17<br>16<br>34 | 23 | 15<br>30<br>20 | 22 | 12<br>14<br>13 | 13 | 16 18 |
| 25 | 30 | 0,7<br>1,5<br>2,0 | 1,4 | 32 | 12<br>21<br>43 | 25 | 15<br>31<br>25 | 24 | (a)<br>9<br>22<br>19 | 17 | 14 |
| 0 | 0 | 0,6<br>1,4<br>2,0 | 1,3 | 24 | 21<br>38<br>60 | 40 | 20<br>30<br>40 | 30 | (b)<br>17<br>26<br>37 | 27 | 29 |

FIG. 5

PROCESS FOR THE CONTINUOUS DIP COATING OF A STEEL STRIP

BACKGROUND OF THE INVENTION

This invention relates to a process for the continuous dip coating of a steel strip.

The continuous dip coating process for a steel strip is a technique which is known and has been extensively applied for many years. Basically, it consists of passing a steel strip through a bath of molten zinc or zinc alloy then solidifying the coating after having regulated its thickness.

In accordance with this technique, it is normal practice to use, in particular, zinc-aluminum alloys. It is known that these alloys have a eutectic which is in the proportion of approximately 5% by weight of aluminum. A hypereutectic zinc-aluminum alloy is therefore a zinc-aluminum alloy containing at least 5% by weight of aluminum.

This invention relates to the deposition of a coating based on a hypereutectic zinc-aluminum alloy and, more particularly, comprising an alloy which contains, typically, by weight, in addition to the zinc, 55% of aluminum and 1.6% of silicon. These alloys combine the high resistance to corrosion of the aluminum and the cathodic protection provided by the zinc. The purpose of adding silicon is to modify the reaction between the iron in the steel strip and the aluminum in the coating. In the absence of silicon, this reaction results in a very considerable loss of iron and a coating which is entirely transformed into Fe-Al which has no adherence or ductility.

It is however apparent that this coating, as known, presents serious defects affecting the adherence and ductility when it is subjected to bending or forming, as is frequently necessary in the case of panels intended, in particular, for manufacturing purposes. These defects cause the coating to crack and the cracks formed even spalling. This brittleness and lack of adherence of the coatings, as known, appears to be the result of three principal causes. Firstly, the coating comprises a two phase metastable mixture which does not solidify simultaneously. This results in the appearance of a structure which comprises zones rich in zinc and zones rich in aluminum, which have different physical properties generating internal stresses. Also, at the interface between the steel substrate and the zinc-aluminum coating, a layer of brittle intermetallic particles of Fe-Al-Zn-Si type is formed. Finally, the silicon added to modify the reaction between the iron and the aluminum does not remain entirely in solution. On cooling, it is precipitated in the form of needles which are the origin of stress concentrations and result in the brittle nature of the coating.

An attempt has already been made to remedy these disadvantages by means of specific heat treatments. In particular, it has been proposed to heat the coating to 300°-350° C. for three minutes or, again, to carry out an annealing stage at 150° C. for a period of twenty-four hours. These treatments have been found to be technically satisfactory but are not viable economically because of the resulting costs.

BRIEF SUMMARY OF THE INVENTION

The purpose of this invention is to provide a process for the continuous dip coating of a steel strip which does not include the disadvantages described above and which confers, by using simple and economic methods acceptable under industrial conditions, excellent adherence and ductility characteristics to the coating without altering its ability to protect against corrosion. It also extends to products made from steel such as, strips or sheets provided with a coating applied using this process.

In accordance with this invention, a process for the continuous dip coating of a steel strip where the steel strip is passed through a bath of hypereutectic zinc-aluminum alloy with a silicon content of 1% to 2% by weight, is characterized in that strontium is added to the coating bath, the quantity being equal to 0.2% maximum by weight and at least one element selected from among vanadium and chromium, the quantity of each being equal to 0.2% maximum by weight. Preferably, the coating bath has an aluminum content of between 50% and 60% by weight and, again, preferably, approximately 55% by weight.

In accordance with a particular application of the process comprising the invention, strontium is added to the coating bath in a quantity less than 0.05% by weight, and vanadium is added in a quantity less than 0.1% by weight.

In the case of this combined addition, the quantities of strontium and vanadium added to the coating bath are, preferably, respectively between 0.005% and 0.050% and between 0.05% and 0.075% by weight.

In accordance with another application of the process comprising the invention, strontium is added to the coating bath in a quantity less than 0.1% by weight, and chromium is added in a quantity less than 0.15% by weight.

In the case of this combined addition, the quantities of strontium and chromium added to the coating bath are, preferably, respectively between 0.0001% and 0.050% by weight and between 0.005% and 0.10% by weight.

In accordance with another application of the process comprising the invention, strontium is added to the coating bath in a quantity between 0.005% and 0.1% by weight, vanadium is added in a quantity between 0.02% and 0.1% by weight and chromium is added in a quantity between 0.001% and 0.1% by weight.

In the case of this triple addition, the quantities of strontium, vanadium and chromium added to the bath are, preferably, respectively between 0.01% and 0.075% by weight, between 0.025% and 0.050% by weight and between 0.025% and 0.075% by weight.

This invention also relates to products made from steel, such as, strips or sheets, coated in accordance with the processes described above and consequently relates to coatings which contain strontium in combination with vanadium and/or chromium in the proportions stated.

In particular, a steel product in accordance with the invention is provided with a coating based on a hypereutectic zinc-aluminum alloy, with a silicon content of 1% to 2% by weight and the coating also contains strontium and at least one element selected from among vanadium and chromium, each of these comprising a quantity equal to 0.2% maximum by weight.

In accordance with different variants of the steel product comprising the invention, the coating may contain by weight:

a maximum of 0.05% of strontium and a maximum of 0.1% of vanadium and, preferably, between 0.005% and 0.050% of strontium and between 0.050% and 0.075% of vanadium a maximum of 0.1% of strontium and a maximum of 0.15% of chromium and, preferably, between 0.0001% and 0.050% of strontium and between 0.005% and 0.10% of chromium between 0.005% and 0.10% of strontium, between 0.02% and 0.10% of vanadium and between 0.001% and 0.10% of chromium and, preferably, between 0.010% and 0.075% of strontium, between 0.025% and 0.050% of vanadium and between 0.025% and 0.075% of chromium.

It is also known that, in the case of coated products in general, the visual appearance of the coating often constitutes a first indication of the quality of this coating. In the more particular case of steel products provided with a coating based on zinc-aluminum, such as, strips and sheets, this visual appearance depends, to a large degree, on the crystallization pattern of the zinc forming the coating. It is pointed out that this crystallization pattern of a coating is, in fact, the design formed by the pattern of the grains in the coating on the surface of the coating. In the case of the normal alloys used for coating and based on zinc-aluminum, the size of the grains is such that the crystallization pattern has, typically, approximately 500 grains or "patterns" per $dm^2$ and, in any case, less than 1,000 patterns per $dm^2$. Also, this conventional crystallization pattern is frequently affected by the nature of the product on which the coating is deposited. In particular, the crystallization pattern is sensitive to the surface condition of the product and, in particular, the surface roughness and the quality, that is, the chemical composition of the steel product. This sensitivity may constitute a disadvantage in the case of continuous coating processes as there may be a variation in the crystallization pattern between two strips of steel of different origins and assembled end to end, or between the two faces of the same strip.

Contrary to prior art, the product coated in accordance with the invention has a very regular pattern, irrespective of the surface condition and the quality of the steel product on which the coating is applied. The product in accordance with the invention is distinguished by a crystallization pattern which is clearly finer than the conventional pattern, that is, a crystallization effect which comprises at least 1,000 patterns per $dm^2$ and, preferably, between 1,200 and 1,500 patterns per $dm^2$.

The crystallization pattern of the products in accordance with the invention is finer and more regular than the conventional crystallization pattern. It shows a finer granular structure within the coating.

There are several methods of obtaining the finer crystallization pattern proposed by this invention.

One method is to project a fine powder, for example zinc, onto the coating during its solidification. However, this method is costly and is also likely to cause random variations in the regularity of the crystallization pattern.

Another interesting way of increasing the density of the crystallization pattern consists in incorporating suitable proportions of certain alloy elements into the coating, for example strontium and vanadium and/or chromium. The concentrations of these elements in the coating are preferably not greater than 0.2% by weight. In these conditions, the product has a fine and regular crystallization pattern, the visual appearance of which is not altered by variations in the quality of the base product.

In order to illustrate the characteristics and the advantages of steel products coated in accordance with this invention, several series of tests have been carried out in the laboratory and under industrial production conditions.

As an example, various properties of a series of samples of steel products, coated using the process in accordance with the invention, have been examined. The microstructures have been examined using an electron scanning microscope on polished sections which have not been etched (backward diffusion electron observation), the distribution of the alloy elements being determined by means of X-EDS spectrometry (energy dispersion), in accordance with the ASCN (area scan) procedure well known to persons experienced in this field, complemented by X-WLS spectrometry (wavelength dispersion) in the case of strontium. The properties examined are the ductility and adherence of the coating, their resistance to corrosion and the stability of the coating baths over a period of time.

The ductility and adherence of the coatings have been determined by means of mechanical tests which reproduce the forces and stresses encountered, in particular, in the manufacture of panels.

The "FlexnT" test is a bending test at $\pi$ radians (180°) on n times the thickness T of the testpiece, this being cut to 50 mm by 100 mm following coating.

The "Profil 15" test is a forming test carried out on a testpiece of 30 mm×120 mm, the ends being held in suitable tooling and the central part, with a length of 80 mm, being subjected to the transversal displacement a punch over a distance of 15 mm. This test combines tensile and bending forces.

The results of these two tests are expressed in accordance with the number of cracks observed on a metallographic section taken in the deformation zone.

The resistance to corrosion was determined by a standard saline mist corrosion test.

Finally, the stability of the coating baths, over a period of time, is verified by regularly measuring the composition of the bath concerned.

In order to determine the advantages of the process in accordance with the invention, these results will be compared with those obtained with a conventional coating, either in the untreated condition or after being maintained at 150° C. for a period of twenty-four hours, this being considered, technically, to be a reference treatment.

An assessment of the effects of the modification to the alloy, in accordance with the invention, is based on a comparative examination of various laboratory samples, together with a comparison of sheets coated in accordance with a continuous process carried out on an industrial production line. In the case of the laboratory samples, the coatings were applied under strictly identical conditions, as follows:

| | |
|---|---|
| Dimensions of the sample: | 60 mm × 140 mm |
| Atmosphere: | N2 - 5% $H_2$; dew point between −35° C. and −40° C. |
| Thermal cycle: | |
| Furnace temperature: | 720° C. |
| Heating time: | 2 min 50 s. |
| Hold time: | 2 min 50 s. |
| Natural cooling: | 11 s ($T_{bath}$ = 600° C.) |

-continued

| | |
|---|---|
| Dip coating: | |
| Immersion: | 2.5 s |
| Nominal speed: | 62 m/min |
| Coating thickness: | 25 μm |
| Rapid cooling: | 31° C./s. |

The laboratory tests have included a coating in a conventional Zn-Al-Si alloy (Zn-55% Al-1.6% Si), taken as the reference and with the denomination AZREF 89 and also coatings comprising the three modified alloys in accordance with the invention, known as AZVSR, AZCRSR and AZCRVSR. These modified alloys have been obtained from the reference alloy, by the addition of vanadium and strontium (VSR1:0.055% V-0.0093% Sr; VSR2 : 0.072% V-0.023% Sr), chromium and strontium (CRSR1:0.0063% Cr-0.0004% Sr; CRSR2 : 0.090% Cr-0.045% Sr) and chromium, vanadium and strontium (CRVSR: 0.055% Cr-0.035% V-0.024% Sr), respectively. For the purpose of further comparison, certain coatings in a modified alloy have also been maintained at 150° C. for a period of twenty-four hours or heated to 300° C. for three minutes.

The samples of industrial products examined in accordance with another series of tests have been taken from strips of steel of various thicknesses between 0.6 mm and 2 mm. The coatings, both conventional and improved in accordance with the invention, have been applied in an installation operating under normal industrial conditions, their thickness varying from 20 μm to 30 μm.

These samples have been subjected to full bend tests and draw tests which have permitted an assessment of the ductility of the coating, its performance when formed by a drawing process and its resistance to corrosion.

BRIEF DESCRIPTION OF THE DRAWINGS

The invention will be described in more detail below with reference to the results of the mechanical tests and the appended drawings wherein;

FIG. 5 is a table of measured values showing various properties of the coatings;

DETAILED DESCRIPTION

Figure 1:
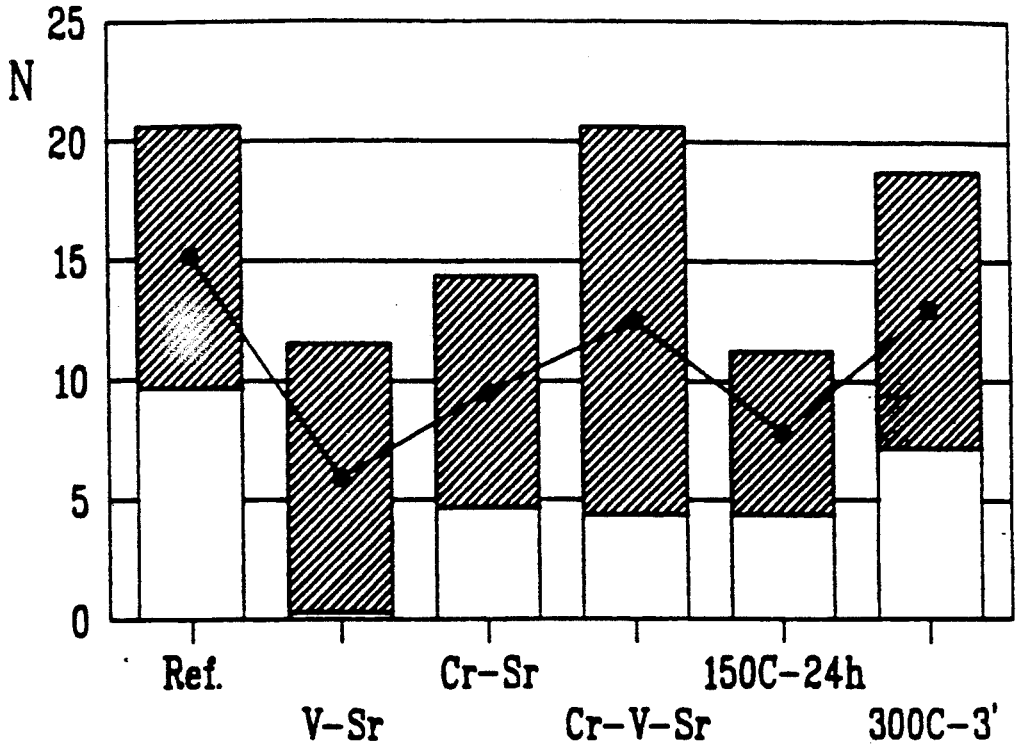
FIG. 1 is a diagram showing the resistance to cracking of the various coatings, during the FlexnT test.

FIG. 1 relates to the Flex2T bending tests, that is, over twice the thickness T of the testpiece. It confirms the improvement in ductility and adherence obtained by the addition of V-Sr, Cr-Sr or Cr-V-Sr to the reference alloy. This addition changes, respectively, the average number of cracks N from 15.3 for the reference alloy, respectively to 6.2; 9.6 and 12.3 for the modified alloys V-Sr, Cr-Sr and Cr-V-Sr. This Figure also permits an assessment of the effects of the heat treatment on the tendency to cracking.

The application of suitable tests in order to evaluate the data on the basis of FIG. 1, in particular, an analysis of the variance, confirms the statistical significance of the favorable effects of the modification to the alloy used for the coating. This effect is particularly marked in the case of the modified alloy V-Sr, which gives results which have as many advantages as the ductilizing heat treatment at 150° C./24 hours and better than the results obtained from the heat treatment at 300° C./3 minutes.

Figure 2:
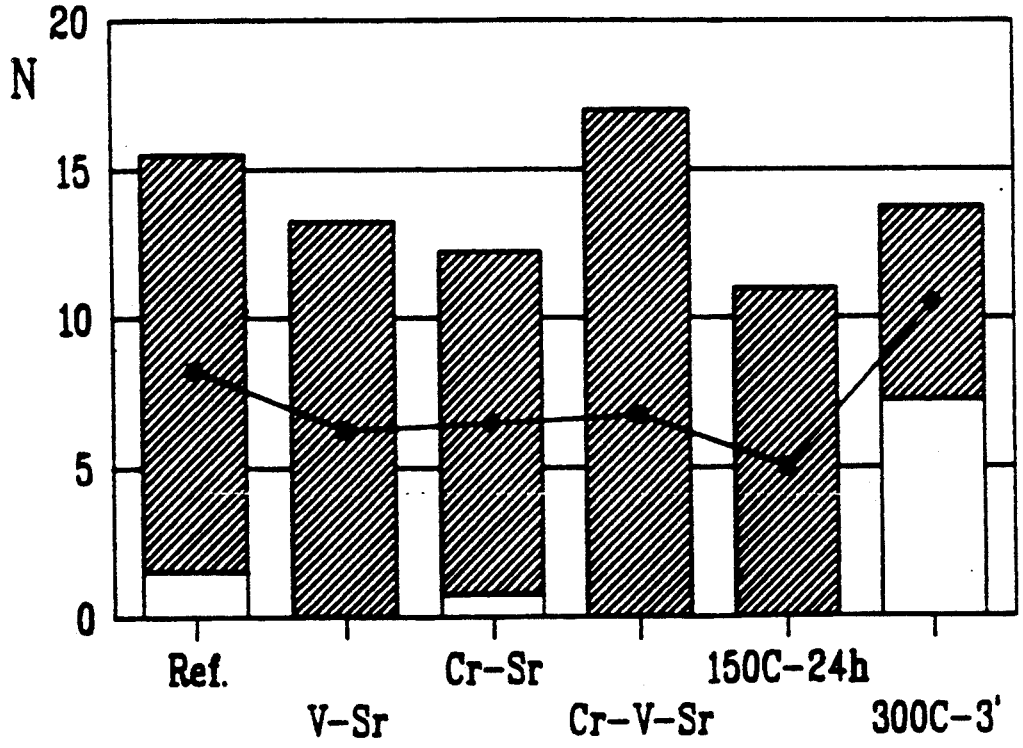
FIG. 2 is a diagram showing the resistance to cracking of the various coatings during the Profil 15 test.

FIG. 2 shows the results obtained by the Profil 15 forming tests. It also confirms the improved ductility of the modified coatings relative to the reference alloy coating. Here, also, the Figure permits an assessment of the effects of the heat treatment. The average number of cracks in the modified alloys is considerably reduced relative to the untreated condition and even relative to the reference alloy and basically approaches the value for the heat treated alloy.

The application of suitable tests to the evaluation of data on the basis of FIG. 2, in particular, an analysis of the variance, confirms the considerable statistical significance of the favorable effects due to additions of V-Sr and Cr-Sr on the tendency to cracking when formed.

Figure 3:
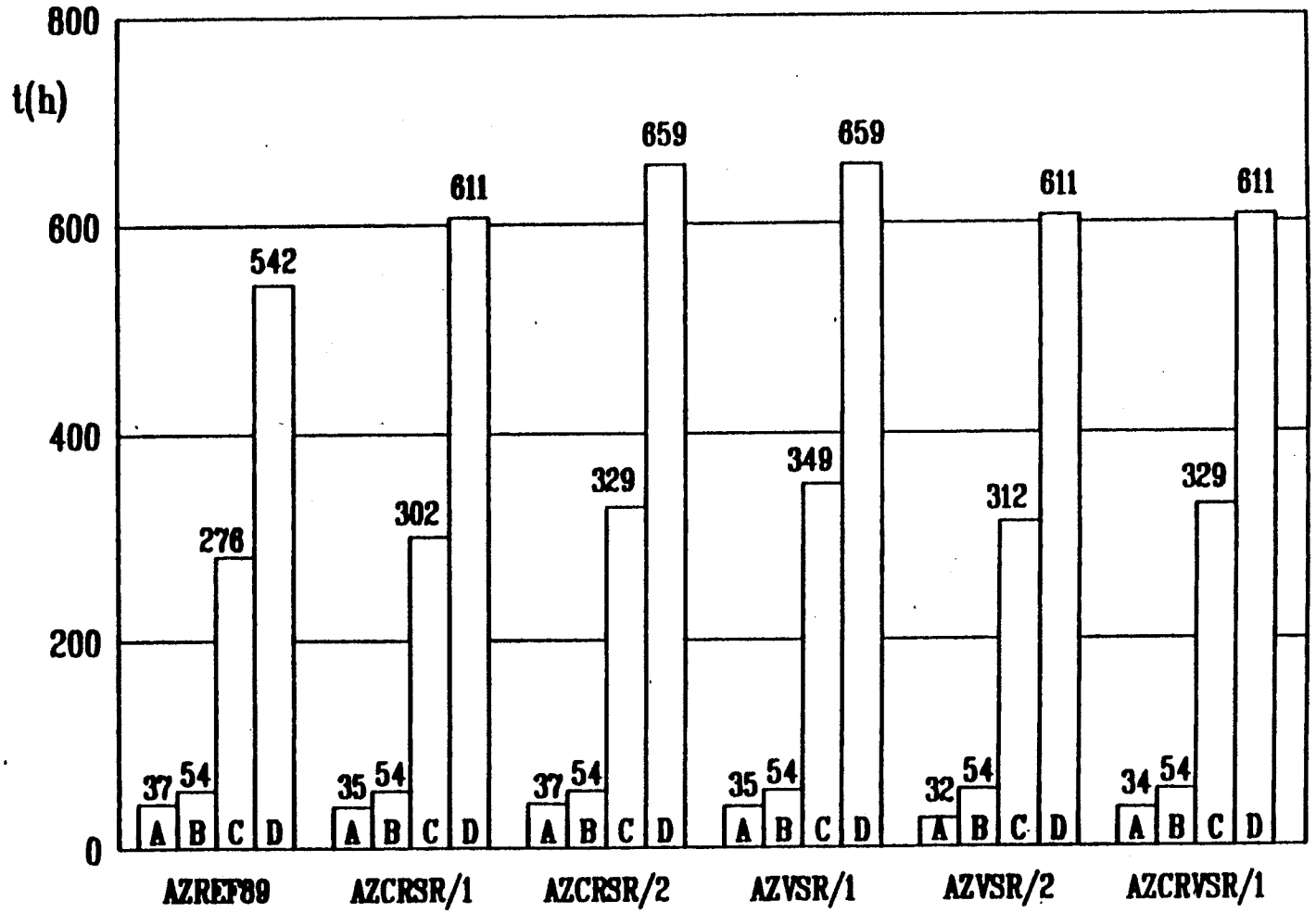
FIG. 3 is a diagram showing a comparison between various coatings in modified alloys and a reference alloy obtained in the laboratory, when subjected to a saline mist corrosion test.

Finally, FIG. 3 shows the results obtained during the saline mist corrosion test, for the coating using the reference alloy AZREF 89 and also for different modified alloys. The comparison shows that the modified alloys have an improved resistance to corrosion when compared with the reference alloy, as regards:

the appearance of blisters at the edge of the samples :zones B one-half of the surface is covered with black stains: zones C 90% of the surface is covered with black stains: zones D Only the appearance of white rust over 25% of the surface (zones A) is not significantly affected. The proposed modifications to the alloy therefore have no unfavorable consequences as regards the resistance to corrosion when subjected to a saline mist test.

In the case of the stability of the coating baths, over a period of time, measurements concerning a modified V-Sr alloy bath have revealed that the strontium content does not vary significantly.

In this case, the conventional coating has a nominal composition consisting, by weight, of 55% aluminum and 1.6% silicon, the remainder being zinc.

The coating showing the improved crystallization pattern in accordance with the invention also contains 0.010% to 0.025% by weight of strontium and 0.010% to 0.030% by weight of vanadium.

The samples of the sheets examined have been taken from steel strips of various thicknesses between 0.6 mm and 2 mm. The coatings, both conventional and improved in accordance with the invention, were applied in an industrial installation operating under normal conditions and their thickness varied from 20 μm to 30 μm.

Figure 4A:
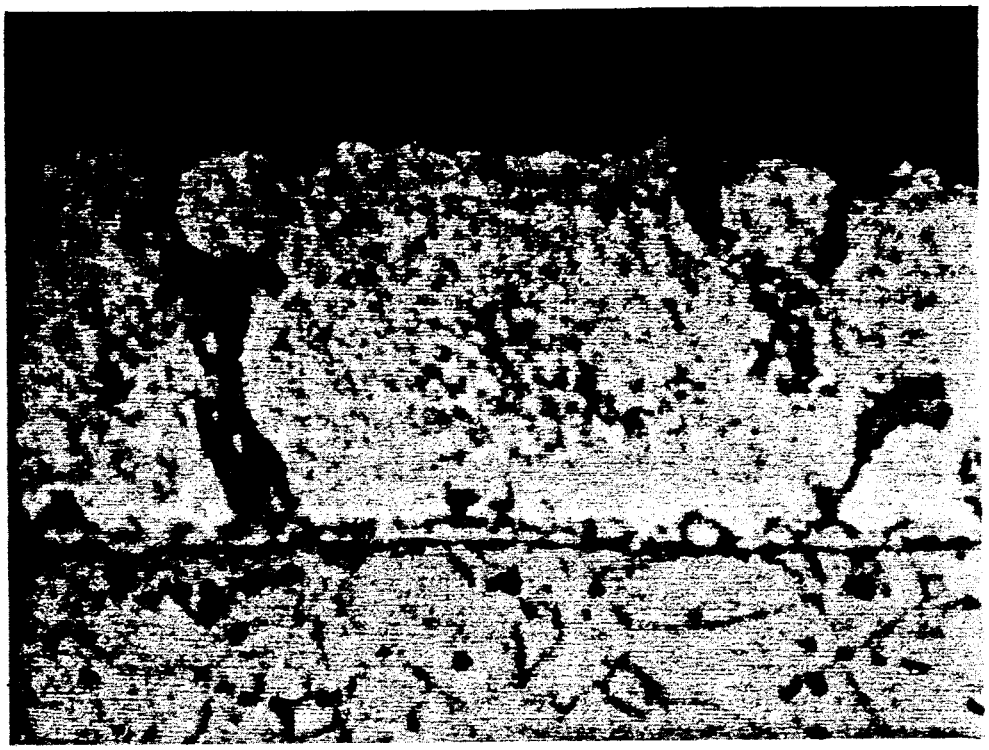
FIGS. 4(*a*) and 4(*b*) are photographs showing metallographic sections through a conventional and a modified coating, respectively, and the crystallization pattern in accordance with the invention, obtained by incorporating strontium and vanadium in suitable proportions, as described above.
Figure 4B:
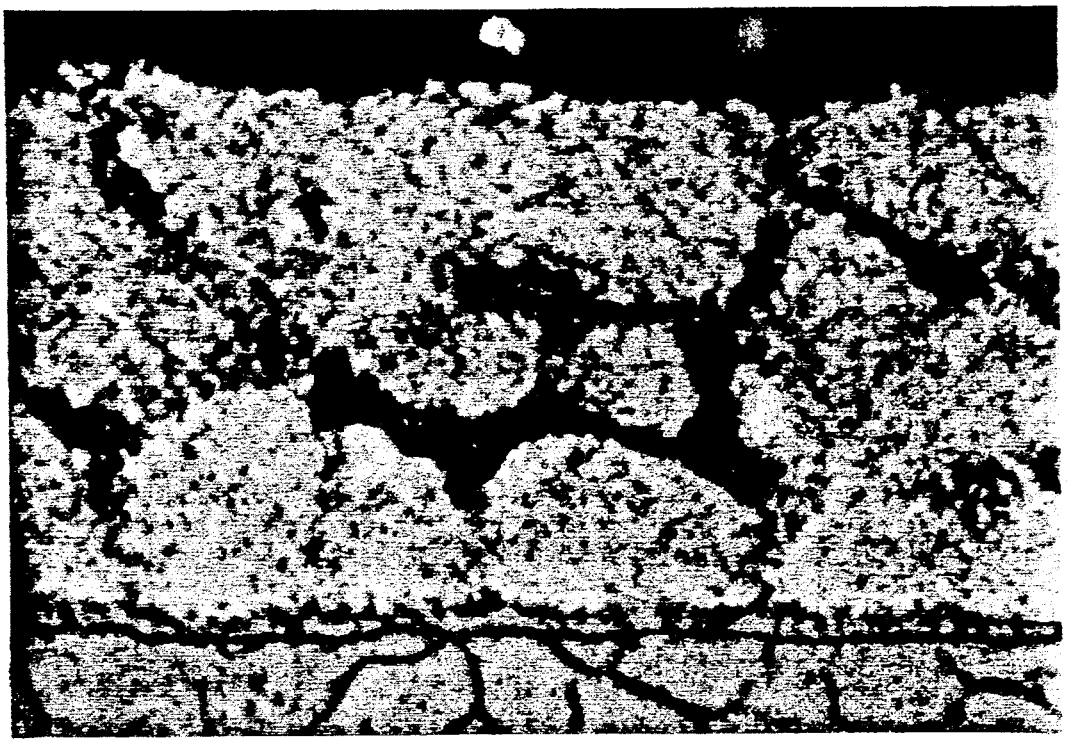

FIG. 4(*a*) and FIG. 4(*b*) each show, respectively, a metallographic section through a conventional and a modified coating.

FIG. 5 is a table of measured values showing, in particular, the improved ductility of the coating.

Figures 6A, 6B:
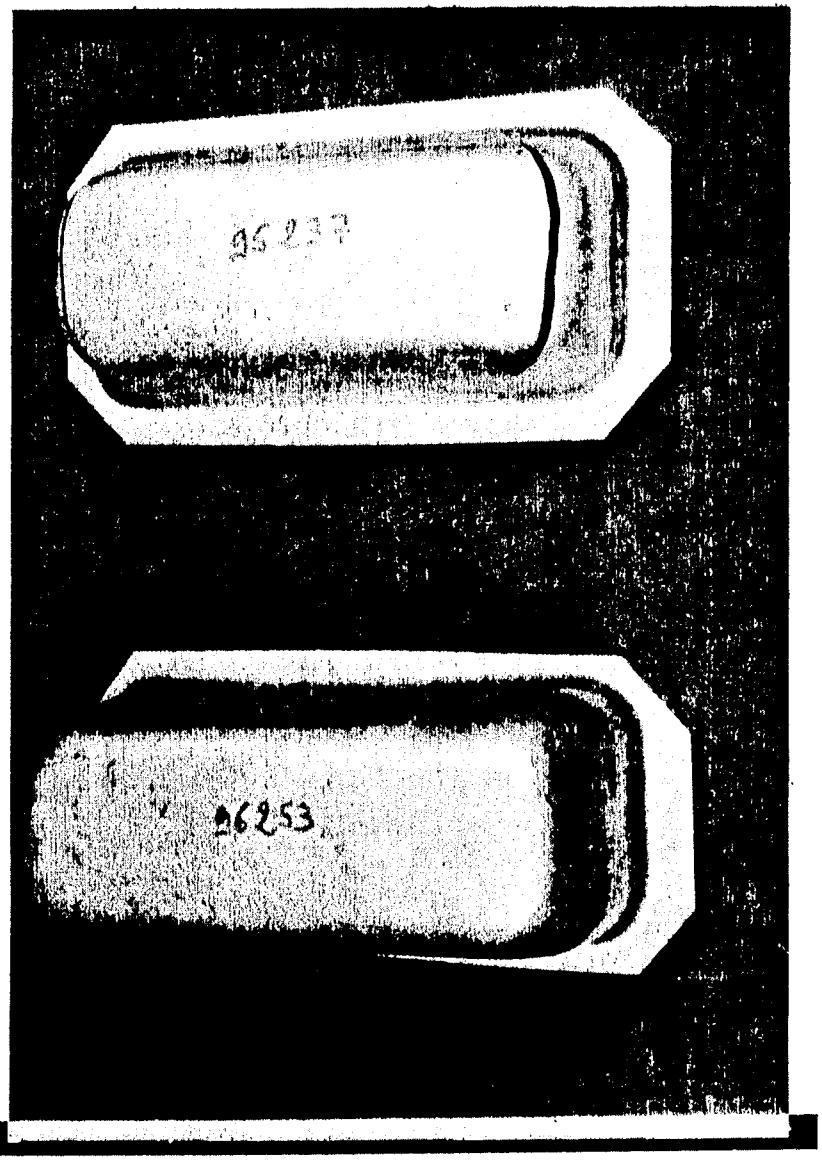
FIGS. 6(*a*) and 6(*b*) are parts of a photograph showing the increase in draw depth which is possible with the modified coating.

FIG. 6(*a*) and 6(*b*) illustrates the increase in the draw depth which is possible with the modified coating.

Figures 7A, 7B:
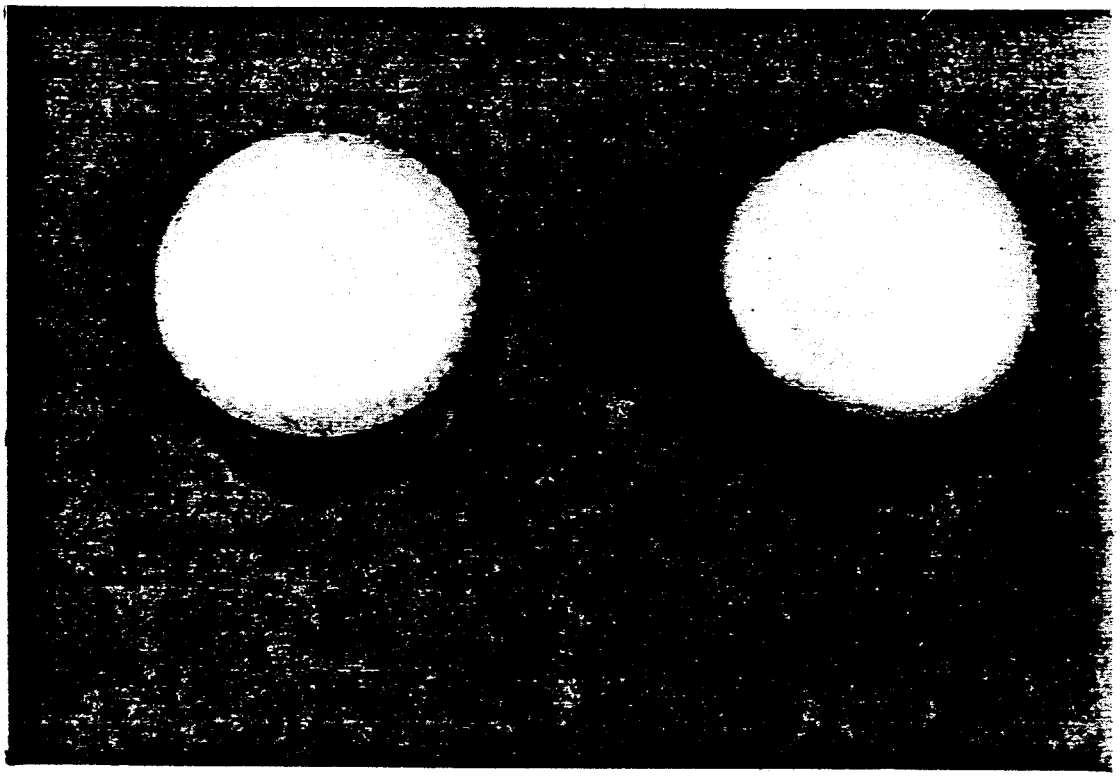
FIGS. 7(*a*) and 7(*b*) are photographs showing improved suitability of the invention relative to a drawing operation.

FIG. 7 is another illustration of the improved suitability relative to a drawing operation.

With the exception of FIG. 5, which relates to several compositions, the other Figures correspond to the presence of 0.020% of strontium and 0.025% of vanadium in the modified coating.

FIGS. 4(*a*) and 4(*b*) are a dual micrograph which, in section, the metallographic structure of the coating deposited on a steel sheet. The intermetallic layer 2 formed between the steel 1 and the coating 3 appears slightly more regular in the case of the modified coating FIG. 4(*b*). Also, its thickness is practically unchanged relative to the conventional coating of FIG. 4(*a*). Also, the long isolated needles of silicon 4 which can be observed in the conventional coating have disappeared in the case of the modified coating where the silicon is in the form of globules and these globules form a system.

The Table shown in FIG. 5 groups together the results of the full bend tests carried out on samples with several different coating compositions.

For each coating composition, the strontium (Sr, %) and the vanadium (V, %) contents are given, together with the thickness of the sheet for each sample ($\bar{e}$, mm) and the mean thickness (e, mm), the thickness of the coating (AZ, μm), the actual number (n) and the mean number ($\bar{n}$) of cracks, the actual mean width (L, μm) and the mean value ($\bar{L}$, μm) for the cracks, together with the total surface (%) laid bare by the cracks, as determined by an estimate using the microscope (actual value S, mean $\bar{S}$) or by calculation. These values are also given for the reference samples, where the coating does not contain strontium or vanadium.

These results reveal a net reduction of approximately 35% to 40% in the tendency to cracking of the modified coating. This reduced tendency to cracking represents a corresponding increase in the ductility of the coating. This also results in an improvement in the suitability of the coated products to deformation, in particular, when using a draw process.

The Table given in FIG. 5 also shows the condition of a sample which has been fully deformed using a bend test, this following a corrosion test cycle in accordance with standard DIN 50018 (Kesternich test). In the deformed zone, the conventional coating shows approximately 50% of red rust (b) whereas the modified coating remains intact (a). This improvement appears to be the result, in particular, of the reduced tendency to cracking of the coating.

Draw tests have also revealed the excellent performance of the modified coating as regards lubrication.

FIGS. 6(*a*) and 6(*b*) show that a modified coating 6(*b*) permits a deeper draw operation than the conventional coating 6(*a*).

FIG. 7(*a*) and 7(*b*) also shows that the modified coating 7(*b*) permits a draw operation under extreme deformation conditions where, in the case of a conventional coating 7(*a*), a draw operation is impossible or unsatisfactory, even if a lubricant is applied.

The favorable performance of the modified coatings, as illustrated in FIGS. 5 to 7, also appears to be influenced by the modification in the layer of intermetallic compounds resulting from the modification to the coating. These intermetallic compounds possess an improved ductility relative to conventional coatings. This results in an improved adherence of the coating and, consequently, a reduced tendency to flaking when forming a coated product.

Figure 8A:
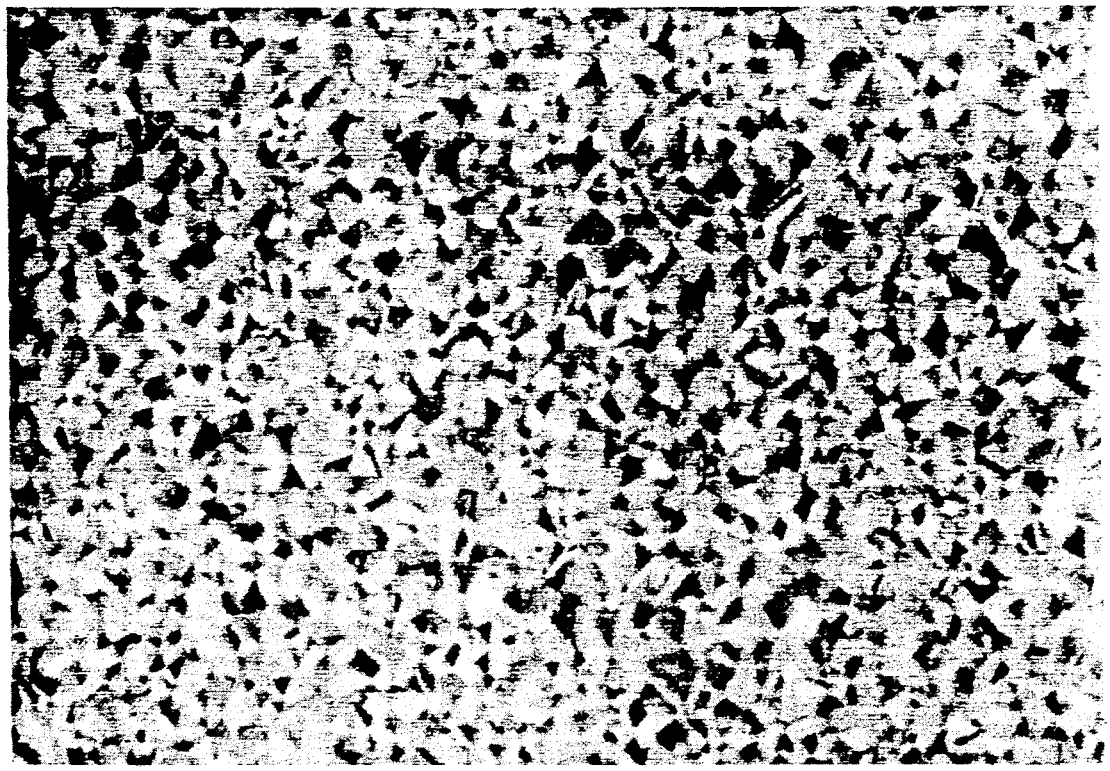
FIGS. 8(*a*) and 8(*b*) are photographs, produced to the same scale, of two coated sheets showing respectively (a) a conventional crystallization pattern and (b) an improved crystallization pattern in accordance with the invention.
Figure 8B:
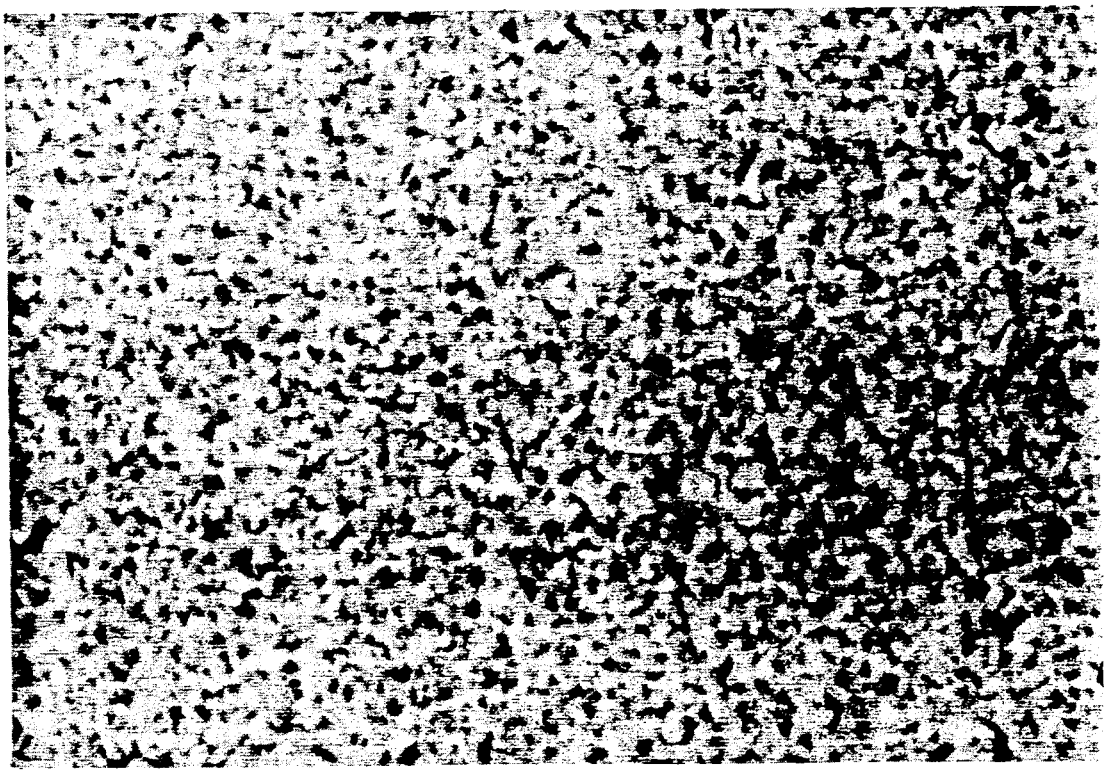

In FIGS. 8(*a*) and 8(*b*), the photograph 8(*a*) shows the crystallization pattern which has relatively large grains and corresponds to a conventional coating based on a hypereutectic zinc-aluminum alloy. The photograph 8(*b*) shows the improved crystallization pattern which is at least twice as dense, in accordance with the invention. The crystallization pattern for products produced in accordance with the invention is finer and more regular than that of conventional products. It is also independent of the grade of steel and the surface condition of the product, in particular, its surface roughness. The products coated in accordance with the invention have a regular visual appearance, despite any difference in the origin and grade of the steel used. Therefore, there is no variation in the crystallization pattern, for example, between two different steel strips assembled end to end and coated in accordance with the same conditions.

The modifications in the composition of the coating alloys, as proposed in accordance with this invention, clearly improve the ductility and adherence of coatings of Zn-Al-Si type, by permitting a more uniform morphological and granulometric distribution of the intermetallic compounds at the interface with the substrate and by modifying the structure of the interdendritic spaces where the silicon "needles" are concentrated and therefore form globules in the modified alloys.

In the case of the V-Sr modification, these effects originate in the preferential segregation of the vanadium in the intermetallic compounds and in the association of the strontium with the silicon particles.

Also, this latter modification results in a refinement and a granulometric regularization of the grains comprising the coating (crystallization pattern).

We claim:

1. In a process for the continuous dip coating of a steel strip wherein the steel strip is passed through a bath of zinc with an aluminum content of approximately 55% by weight and a silicon content in the range of 1% to 2% by weight, the improvement comprising:

providing in said coating bath strontium in a quantity in the range of 0.0001% to 0.2% by weight and at least one other element selected from the group consisting of vanadium in a quantity in the range of 0.02% to 0.2% by weight and chromium in a quantity in the range of 0.005% to 0.2% by weight.

2. The process as claimed in claim 1, wherein: said coating bath contains strontium in a quantity of less than 0.05% by weight and vanadium in a quantity of less than 0.1% by weight.

3. The process as claimed in claim 1, wherein: said coating bath contains strontium in a quantity of less than 0.1% by weight and chromium in a quantity of less than 0.15% by weight.

4. In a process for the continuous dip coating of a steel strip wherein the steel strip is passed through a bath of zinc with an aluminum content of approximately 55% by weight and a silicon content in the range of 1% to 2% by weight, the improvement comprising:

providing in said coating bath strontium in a quantity in the range of 0.005% to 0.1% by weight, vanadium in a quantity in the range of 0.02% to 0.1% by weight, and chromium in a quantity in the range of 0.001% to 0.1% by weight.

* * * * *